United States Patent [19]

Focke

[11] Patent Number: 4,909,020

[45] Date of Patent: Mar. 20, 1990

[54] PROCESS AND APPARATUS FOR WRAPPING, ESPECIALLY CIGARETTE PACKS

[75] Inventor: Heinz Focke, Verden, Fed. Rep. of Germany

[73] Assignee: Focke and Co. (GmbH and Co.), Verden, Fed. Rep. of Germany

[21] Appl. No.: 235,856

[22] Filed: Aug. 24, 1988

[30] Foreign Application Priority Data

Aug. 28, 1987 [DE] Fed. Rep. of Germany ..... 3728716

[51] Int. Cl.[4] ..... B65B 11/28

[52] U.S. Cl. ..... 53/466; 53/202; 53/234

[58] Field of Search ..... 53/466, 202, 234, 225

[56] References Cited

U.S. PATENT DOCUMENTS

| | | | |
|---|---|---|---|
| 2,686,393 | 8/1954 | Russell | 53/234 |
| 4,258,528 | 3/1981 | Focke | 53/202 X |
| 4,448,008 | 5/1984 | Pankratz | 53/202 |
| 4,617,780 | 10/1986 | Focke et al. | 53/234 X |

FOREIGN PATENT DOCUMENTS

| | | | |
|---|---|---|---|
| 623446 | 12/1935 | Fed. Rep. of Germany | 53/234 |
| 943495 | 12/1963 | United Kingdom | 53/234 |

*Primary Examiner*—John Sipos

*Attorney, Agent, or Firm*—Sughrue, Mion, Zinn, Macpeak & Seas

[57] ABSTRACT

For the wrapping of articles, especially cigarette packs (10) in an outer wrapping (11) consisting of film material or the like, a high output is required. The cigarette packs (10) come from the preceding packaging machine in a close-packed row (42). Two cigarette packs (10) at a time are pushed upwards out of the close-packed row (42) into pockets (30, 31) of a folding turret (29). During the pushing-in movement, a blank (12, 13) is laid round the respective cigarette packs (10) in a U-shaped manner. The two blanks (12, 13) are separated from a common web of material (47) and fed to the cigarette packs (10) via conveying rollers in an exact position transverse relative to the pushing direction.

20 Claims, 7 Drawing Sheets

PROCESS AND APPARATUS FOR WRAPPING, ESPECIALLY CIGARETTE PACKS

BACKGROUND OF THE INVENTION

The invention relates to a process for wrapping articles, especially cuboid (cigarette) packs into a blank which, during the pushing of the articles into a pocket of a conveying member (folding turret), is laid round the article in a U-shaped manner and the projecting tabs of which are then folded. The invention relates furthermore to an apparatus for carrying out the process.

Cigarette packs are predominantly equipped with an outer wrapping consisting of a thin film. The invention is concerned primarily with the production of the outer wrapping for cigarette packs.

Packaging machines for the outer wrapping of cigarette packs have to be of very high performance in keeping with the high output of the preceding packaging machines for the production of the cigarette packs.

SUMMARY OF THE INVENTION

The object of the invention is, therefore, to improve the production capacity of packaging machines, especially for the outer wrapping of cigarette packs, by the use of the process mentioned in the introduction. Furthermore, the more efficient packaging machine will be of simpler construction and more reliable during the wrapping and folding operations as a result of the process and as a result of the design of the packaging machine.

To achieve this object, the process according to the invention is characterized in that several, especially two articles (cigarette packs) are simultaneously pockets into pockets of a folding turret, a blank at the same time being taken up in a U-shaped manner, the blanks being separated from a common web of material and being conveyed in the correct position into the path of movement of the articles.

In the abovementioned process, the efficiency of the apparatus is the result of the simultaneous wrapping of two cigarette packs at a time. The packaging material is fed to these from a common reel or web of material. As a result, the supply of material can be co-ordinated especially exactly with the short work cycles of the machine. Moreover, it becomes easier to supply the machine with packaging material. The constructive design is also simplified.

The web of material is fed to the wrapping station intermittently, in particular respectively in web portions corresponding to the dimension of two blanks. The blanks are kept ready in the path of movement of the cigarette packs, being directed transversely to these. As a result of a curved, wave-shaped arrangement of the blanks or of the web portion, it is possible to shift the two simultaneously wrapped packs next to one another at a relatively short distance, without the blanks having to cover one another.

The conveying members for feeding the web of material are designed as a conveying roller, at least one of these conveying rollers being a knife roller which produces the web portion and the blanks as a result of an exact severing cut. A conveying roller is assigned to each cigarette pack or to a path of movement thereof. These conveying rollers are equipped with a central slot-shaped passage, through which the packs are pushed, with the blanks held on the outer surface of the conveying rollers being taken up at the sametime time.

According to a further proposal of the invention, the articles to be packaged, especially cigarette packs, are introduced into the pockets of the folding turret from a close-packed row of cigarette packs as a result of a lifting movement, with the blanks being taken up at the same time.

Further features of the invention relate to the design of conveying and holding members for the web of material and for the blanks, to members for pushing the cigarette packs into the folding turret and to the design of the folding turret.

BRIEF DESCRIPTION OF THE DRAWINGS

An exemplary embodiment of the invention is explained in detail below with reference to the drawings in which.

DETAILED DESCRIPTION OF THE INVENTION

Figure 1:
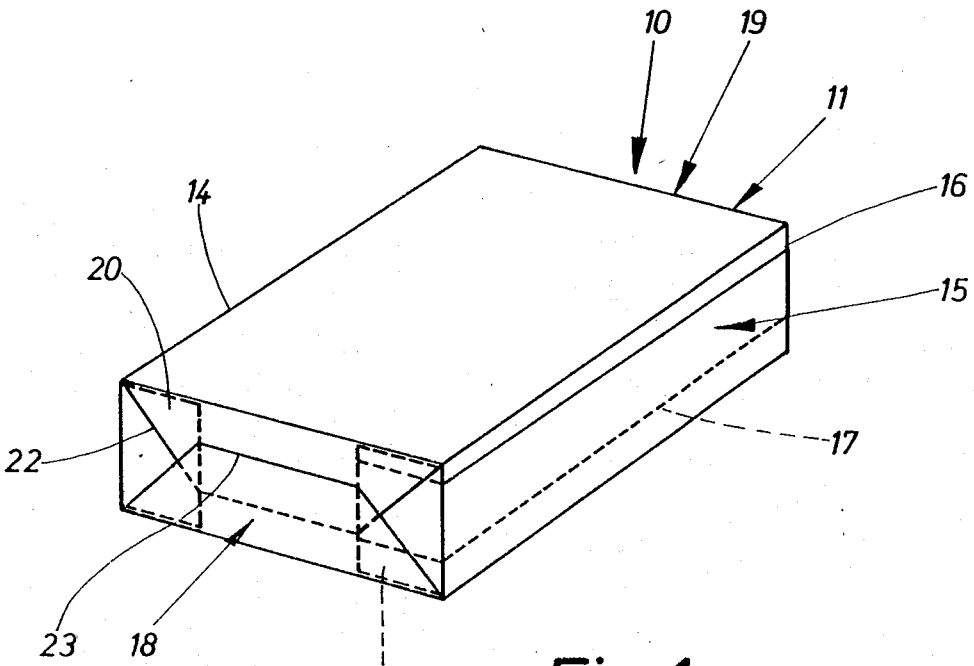
FIG. 1 shows a perspective representation of a cigarette pack to be produced, for example, on the apparatus illustrated.

The apparatus illustrated as an exemplary embodiment in the drawings is suitable especially advantageously for the production or for the wrapping of cuboid cigarette packs 10. In particular, the formation of an outer wrapping 11 as transparent film, polyfilm or the like is concerned.

The outer wrapping 11 consists of a rectangular blank 12, 13. In a first folding step, this is laid round the cigarette pack 10 in a U-shaped manner, thereby forming a side wall 14 located at the front in the direction of movement. On the further side wall 15 opposite this is formed an overlap, extending in the longitudinal direction of the side wall, of appropriately dimensioned side-wall tabs 16 and 17. These are connected to one another, especially by sealing, in the region of their overlap.

A bottom wall 18 and an upper end wall 19, designed the same way, of the outer wrapping 11 are designed as an envelope fold. For this, first, lateral end tabs 20 and 21 in extension of the side-wall tabs 16, 17 are folded against the bottom wall and end wall of the cigarette pack 10. In conclusion, trapezoidal longitudinal tabs 22, 23 are folded against one another with an overlap in order to complete the bottom wall 18 and end wall 19.

The cigarette packs 10 to be wrapped in this way come from a packaging machine (not shown). The cigarette packs 10, lying closely packed next to one another, are delivered on a pack track 24. This consists of a bottom wall 25, an upper wall 26 and lateral guides 27. Within the pack track 24 thus formed, the cigarette packs 10 are conveyed intermittently as a result of the transmission of the advance from one cigarette pack 10 to the other.

In the region of a pushing-in station 28, the cigarette packs 10, by being lifted off from the pack track 24 and as a result of an upward movement, are transferred to a folding turret 29 rotating in steps in a vertical plane.

The folding turret 29 is equipped with pockets 30, 31 arranged respectively in pairs. A cigarette pack 10 is pushed from below into the respective pockets 30, 31 open on the radially outer side, specifically with a blank 12, 13 appropriately kept ready being taken up at the same time. This is thereby laid round the cigarette pack 10 in a U-shaped manner, starting from the side wall 14 located at the front in the direction of movement.

In the pockets 30, 31 arranged parallel to one another in pairs, the cigarette packs 10 are conveyed intermittently over a three-quarter circle, at the same time the folding operations described being executed. In the region of a pushing-out station 32, the cigarette packs 10 equipped with the finished outer wrapping 11 are, once again in pairs, pushed out of the pockets 30, 31 and into a discharge conveyor track 33.

For transferring the two respective cigarette packs 10 to the folding turret 29, a double slide 34 with two jointly moved tappets 35, 36 located at a distance from one another is arranged in the region of the pushing-in station 28. A supporting body 37 common to the tappets 35, 36 is driven up and down in a suitable way, in the present case via a rocker lever 38, with a link 39.

The tappets 35, 36 pass through slot-shaped clearances 40, 41 in the bottom wall 25 of the pack track 24. The tappets 35, 36 are arranged at such a distance from one another that a distance corresponding to the dimensions of two cigarette packs 10 is obtained between the two cigarette packs 10 lifted out of a close-packed row 42 of cigarett packs 10. As a result, between the cigarette packs 10 to be wrapped there is a sufficient distance for the take-up of the two blanks 12 and 13 and for the execution of folding steps in the region of the folding turret 29.

The cigarette packs 10, together with the blanks 12, 13, are conveyed by the tappets 35, 36 up to their final position within the pockets 30, 31. After the return to the initial position (flush with the bottom wall 25), the close-packed row 42 of cigarette packs 10 is conveyed further by an amount corresponding to the dimension of two cigarette packs 10, thus producing a continuous close-packed row 42 which comes up against an end wall 43 of the pack track 24. During the pushing-out of the two cigarette packs 10 to be wrapped, the following part of the close-packed row 42 is prevented from executing a further movement, specifically as a result of the clamping of front cigarette packs 10 on the upper wall 26 of the pack track 24. For this purpose, a part region of the bottom wall 25 is designed as a lifting plate 44. As a result of a slight upward movement, the two front cigarette packs 10 are clamped and consequently the close-packed row 42 is fixed.

The blanks 12 and 13 are respectively kept ready in the correct position above the two upwardly moved cigarette packs 10 in a plane transverse relative to their path of movement. The cigarette packs 10 come out via a pushing-out orifice 45, 46 in the upper wall 26. The blanks 12, 13 are kept ready above this pushing-out orifice 45, 46.

The two blanks 12, 13 each assigned to a cigarette pack 10 are separated from a common continuous web of material 47 consisting of packaging material (film). The web of material 47 drawn off intermittently from a reel (not shown) is fed to the pushing-in station 28 essentially horizontally, but at all events transversely relative to the upwardly directed path of movement of the cigarette packs 10. Two driven and appropriately controlled drawing rollers 48, 49 ensure an exact advance. The web of material 47 then runs over several conveying rollers which can be driven to rotate. Of these, one following the drawing rollers 48, 49 is designed as a knife roller 50 with a rotating severing knife 51 and with a stationary counterknife 52. The dimensions of the knife roller 50 are such that, in conjunction with an appropriate relative position of severing knife 51 and counter-knife 52, a severing cut 53 for separating the two blanks 12 and 13 from one another and then a further severing cut 54 for separating the (second) blank 13 from the web of material 47 are made at a suitable point. The knife roller 50 is equipped, next to the severing knife 51, with suction bores 55 which by means of suction air fix the front free end of the following web of material 47 on the knife roller 50.

Figure 4:
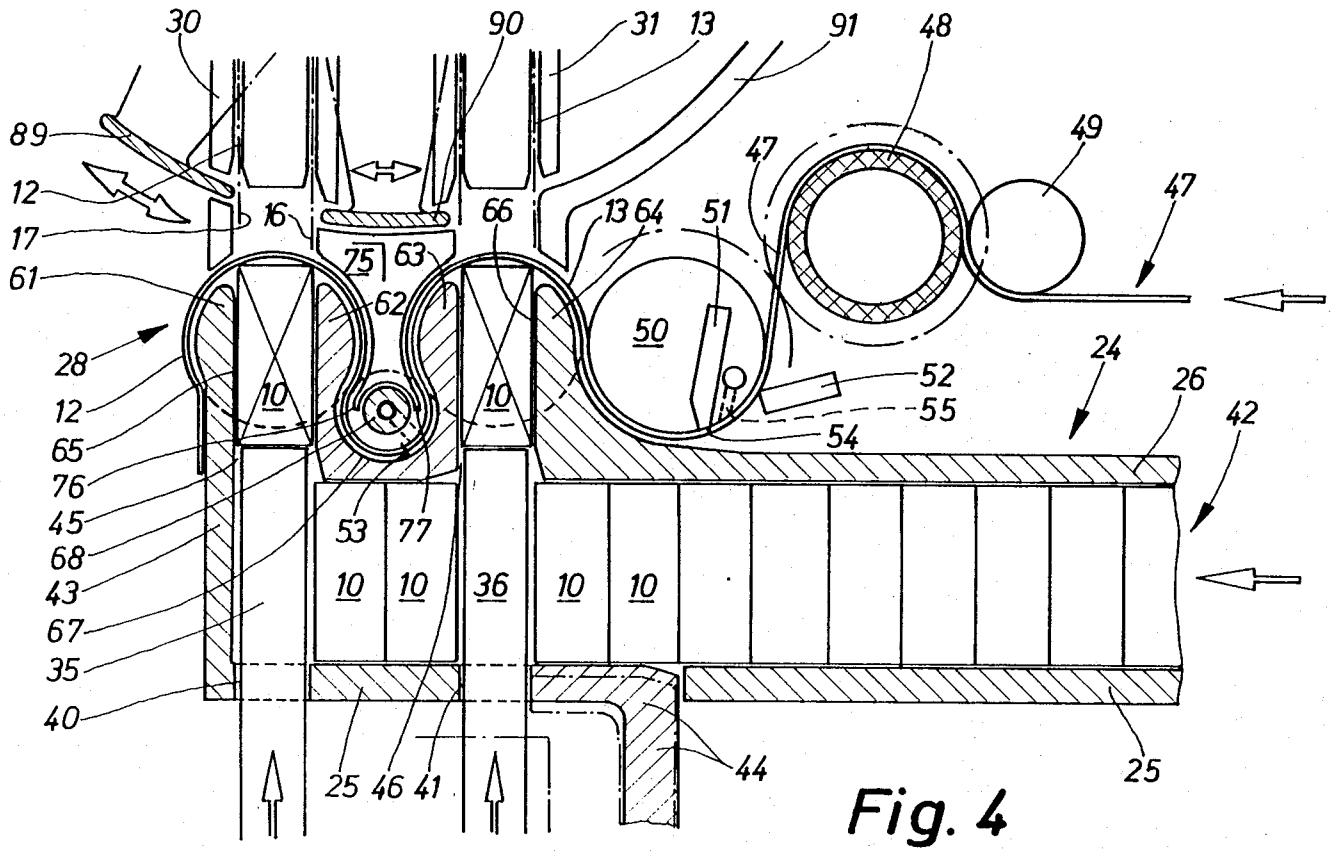
FIG. 4 shows a cutout of the apparatus in a representation corresponding to that of FIG. 2, on an enlarged scale.

During each work cycle, the web of material 47 is conveyed by the amount of a web portion corresponding to the dimension of the two blanks 12 and 13. During transport, the blanks 12, 13 are severed and are separated from the web of material 47. After the knife roller 50, the web of material 47 or the blanks 12, 13 are transferred directly to the periphery of further roller-like conveying members which convey the web of material 47 into the folding position with pronounced loops (FIG. 4).

The roller conveyors 56 and 57 in the region of the pushing-in station 28 serve at the same time as holding members for the blanks 12, 13 in the exact relative position in elation to the upwardly directed path of movement of the cigarette packs 10. The blanks 12, 13 are drawn off with a slipping action from these roller conveyors 56, 57 during the upward movement of the cigarette packs 10.

In the exemplary embodiment illustrated, the roller conveyors 56, 57 consist of lateral suction discs 58, 59 which can be driven to rotate. These are respectively equipped on the outside with drivable shaft journals 60. The suction discs 58, 59 are so dimensioned in their axial direction and arranged at a distance from one another that only edge strips of the web of material 47 or of the blanks 12, 13 rest on the periphery of the suction discs 58, 59 and are held by these by means of suction air. This edge strip corresponds here to the width of those parts of the blanks 12, 13 which project beyond the cigarette pack 10 in this phase and which serve for the subsequent formation of the bottom wall 18 and end wall 19.

Between the lateral suction discs 58, 59 are formed vertical supporting walls 61, 62 and 63, 64. These are assigned to the suction discs 58, 59 in pairs as a stationary immovable addition to the roller conveyors 56, 57. The supporting walls 61 to 64 are designed so that a gap-shaped passage orifice 65, 66 is formed on the inside in a continuation of the pushing-out orifices 45, 46 for pushing through the cigarette packs 10. In the exemplary embodiment shown, the supporting walls 61 to 64 are connected to the upper wall 26 of the pack track 24 or form part of this.

On the outside, the supporting walls 61 to 64 are shaped so that, in the region of the blanks, the blanks 12, 13 rest against rounded or curved outer faces. In actual fact, the supporting walls 61 to 64 are matched to the cylindrical design as part of the roller conveyors 56, 57. in the region between the roller conveyors 56, 57, the adjacent supporting walls 62, 63 merge continuously into a guide trough 67 in the form of an arc of a circle, located in the correspondingly shaped top side of the upper wall 26. The web of material 47 or the blanks 12, 13, resting against corresponding guide faces, are conveyed through this guide trough 67. In the end position, the blanks 12, 13 are fixed on the roller conveyors 56, 57 or the suction discs 58, 59 of the latter in such a way that there is a slight eccentricity in relation to the associated cigarette packs 10. As is evident especially from FIG. 4, the cigarette packs 10 are thereby conveyed into the pockets 30, 31 with downward-pointing side-wall tabs 16, 17 of unequal length.

For the exact guidance of the web of material 47 or blanks 12, 13 in the region of the pushing-in station 28, between the roller conveyors 56, 57, particularly in the region of the guide trough 67, is arranged a further guiding and conveying member. This consists, on the one hand, of a guide roller 68 which is rotary-driven in time with the remaining conveying members and which is mounted centrally in the guide trough 67. The guide roller 68 is equipped with several parallel recesses 69 extending all round. Several roller portions 70 arranged at a distance from one another in the axial direction are thereby provided for the support of the web of material 47. These roller portions 70 are each equipped with a suction bore 71 which opens onto the peripheral face and which fixes the web of material 47 of the blanks 12, 13 on the roller portions 70. The suction bores 71 are connected to a central suction line 72 which is connected to a suction-line connection 74 via a suction ring 73 in the region of the pivot bearing of the guide roller 68.

Assigned to the guide roller 68 is a stationary counterbody 75. This is arranged centrally between the roller conveyors 56, 57. The lower region is made arcuate and is matched to the dimension of the guide roller 68. The counterbody 75 is made comb-like here, with fingers 76, 77 directed on both sides. These enter the recesses 69 between the roller portions 70 of the guide roller 68 and ensure that the web of material 47 is guided correctly during the advancing movement, in particular transferred from the periphery of the first roller conveyor 56 to the guide roller 68 and directed from the latter onto the second roller conveyor 57. The counterbody 75 at the same time also performs a stripping function.

The web of material 47 or the blanks 12, 13 loop round the roller conveyors 56, 57 and the guide roller 68 by more than half. The severing cut 53 for separating the two blanks 12, 13 from one another is made in the region of the guide roller 68 somewhat eccentrically, so that, when the blanks 12, 13 are taken over by the associated cigarette packs 10, the blanks 12, 13 are drawn off with a slipping action on the one hand from the roller conveyors 56, 57 and on the other hand, in opposite directions, from the guide roller 68.

Figure 5:
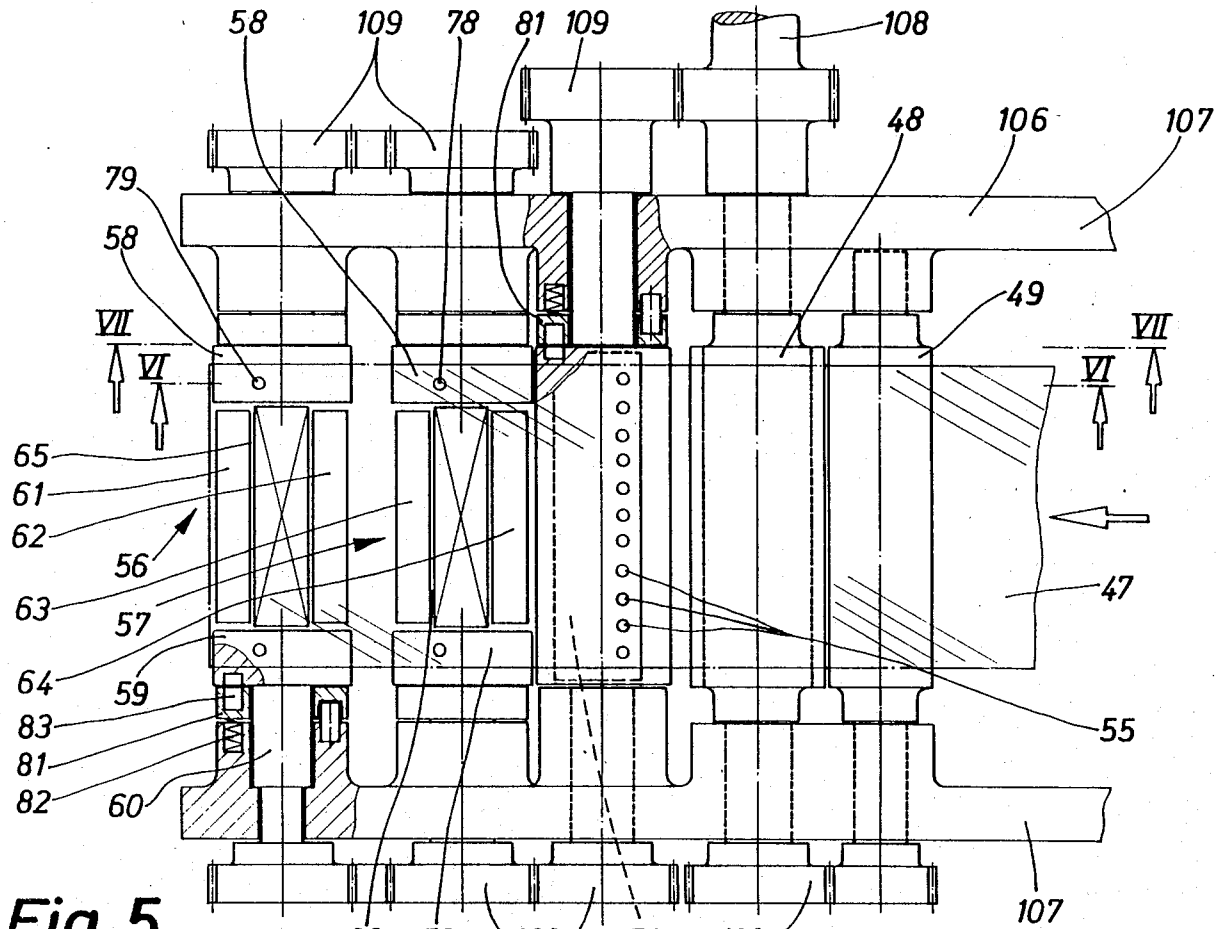
FIG. 5 shows a plan view and horizontal section of a unit for the transport of a web of material, as part of the apparatus according to FIG. 1.
Figure 6:
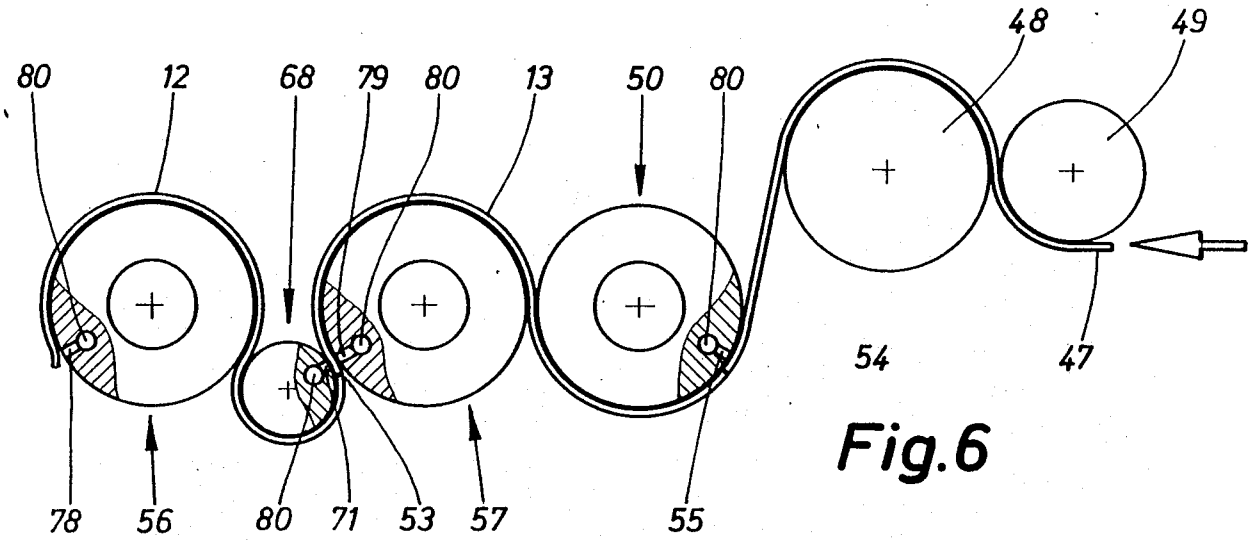
FIG. 6 shows a section or a view in the plane VII--VII of FIG. 5 on an enlarged scale.

The pronounced undulatory course of the web of material 47 or of the blanks 12, 13 is especially evident from FIG. 6. As a result of this shaping of the web of material 47 it is possible to arrange the cigarette packs 10 to be pushed out together at a short distance from one another, despite the considerable dimension of the blanks 12, 13 in the conveying direction. The arrangement of the conveying rollers 50, 56, 57 and 68 in relation to one another is such that the web of material 47 is transferred directly from the periphery of one conveying roller to the other. Each of these conveying rollers is equipped with radially directed suction bores 55, 71 and 78, 79 which respectively grasp an edge region, located at the front in the conveying direction, of the web of material 47 or of the blanks 12, 13 and thus ensure transport. During the transfer of a blank 12, 13 from one of these conveying rollers to the next, the suction bores come momentarily into an adjacent relative position (in FIG. 6, on the roller conveyor 56 and the guide roller 68). During the transition phase, the suction bore 78 which until then has held the blank 13 is vented briefly, so that the blank is transferred reliably to the next conveying roller. The roller conveyors 56, 57 are here respectively equipped only with individual suction bores 78, 79 in the region of the suction discs 58, 59. The knife roller 50 is equipped with a series of suction bores 55 which extends continuously in the axial direction (FIG. 5).

Figure 7:
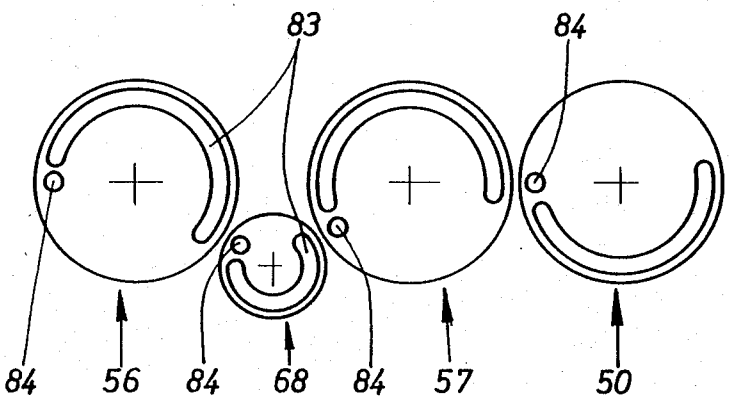
FIG. 7 shows a detail corresponding to the representation of FIG. 6 in an offset plane VII—VII of FIG. 5.

The system of suction bores is designed essentially in a conventional way. The suction bores are connected thereby to suction lines 80 extending axis-parallel inside the conveying rollers. These suction lines 80 open onto the end faces of the conveying rollers on non-rotatably mounted suction discs 81, as shown in section in FIG. 5 by means of the roller conveyor 56. The suction discs 81 are respectively pressed by compression springs 82 slideably and sealingly against the confronting end faces of the conveying rollers. The suction discs 81 are equipped, furthermore, with circular suction grooves 83 which are open towards the end faces of the conveying rollers and with which the ends of the suction lines 80 temporarily coincide during the rotary movement of the conveying rollers. During this phase of coincidence, suction air is transmitted. The length of the suction grooves 83 accordingly corresponds to the duration of the suction phase. Where necessary, a venting bore 84 is made adjacent to the suction grooves 83, but outside these, specifically on the same arc of the circle as the suction grooves 83, so that, during a short phase of the rotary movement, the suction line 80 coincides with the venting bore 84 and thereby effects the already described venting of the suction bores. FIG. 7 shows the relative position of the suction grooves 83 and venting bores 84 for the conveying rollers 50, 56, 57 and 68.

Before the cigarette packs 10 are pushed into the two pockets 30, 31 of the folding turret 29, the cigarette packs 10, together with the blanks 12, 13, pass through a mouthpiece which is formed by stationary outer walls 85, 86 on the one hand, and by the correspondingly shaped counterbody 75 on the other hand.

The cigarette packs 10 are held in the pockets 30, 31 formed respectively by two pocket walls 87, 88, in such a way that the side-wall tabs 16, 17 project from the pockets 30, 31. First folding members, in particular side folders 89 and 90 pivotable to and fro and arranged concentrically relative to the folding turret 29, now come into action directly in the region of the pushing-in station 28. By means of the side folder 89, the shorter inner side-wall tab 17 of the pockets 30, located at the rear in the direction of rotation of the folding turret 29, is folded round first. As a result of an appropriate swinging movement of the side folder 90, the inner sidewall tab 17 of the adjacent pocket 31 is folded round at the same time. During the rotary movement of the folding turret 29 which now begins, the longer outer side-wall tab 16 of the pocket 31 is folded round by the edge of a fixed outer guide wall 91 of the folding turret 29. The corresponding side-wall tab 17 of the cigarette pack 10 in the adjacent pocket 30 is folded in the same way by the side folder 90. The said side folders 89, 90 are mounted on a turret shaft 92 of the folding turret 29 and are actuated in a swinging action by means of connecting rods 93.

As early as during the pushing-in movement of, the cigarette packs 10, together with the blanks 12, 13, into the pockets 30, 31, the first folding operation takes place, in particular the folding in of the lateral end tabs 20, located at the front in the pushing-in direction, by means of folding fingers 94 as a lateral delimitation of the pockets 30, 31. Folding takes place thereby as a result of a relative movement of the cigarette packs 10 in relation to these folding fingers 94. In order to fix the longitudinal tabs 22, 23 thereafter projecting laterally, the folding fingers 94 are equipped with suction bores 95 on the side faces pointing in the direction of rotation of the folding turret 29. The folding fingers 94 at the same time form the lateral delimitations of the pockets 30, 31. Further suction bores 96 open out in the region of end faces 97 of the folding fingers 94. By means of the suction bores 96, the blank parts for forming the opposite lateral end tabs 21 are held in their transversely directed position. By means of the suction bores 96, the inner side-wall tab 17 is at the same time held in its position and the overlapping position of the two side-wall tabs 16, 17 consequently stabilizes. The suction bores 95, 96 are connected to a system of suction channels 98 within the folding turret. Via a central segmental ring 99, the suction channels 98 and consequently the suction bores 95, 96 are supplied with suction air in the way described.

In the region of a first sealing station 100, the mutually overlapping side-wall tabs 16, 17 are sealed by means of a fork-shaped sealing member 101, with heat and pressure being applied. After the folding turret has been shifted further, this operation is repeated in a second sealing station 102 with a further sealing member 103.

In the pushing-out station 32 reached after the folding turret 29 has been shifted once again, the cigarette packs 10 are pushed out of the pockets 30, 31 and into the discharge conveyor track 33 by a common angular pushing-out device 104. During the exit of the cigarette packs 10 from the pockets 30, 31, the lateral end tabs 21 on the outside in the radial direction are folded round by stationary folding thumbs 105 on the entry side of the discharge conveyor track 33.

During the transport of the cigarette packs 10 in the discharge conveyor track 33, the longitudinal tabs 22, 23 still projecting laterally are folded, specifically by means of known folding switches or other folding members.

Figure 2:
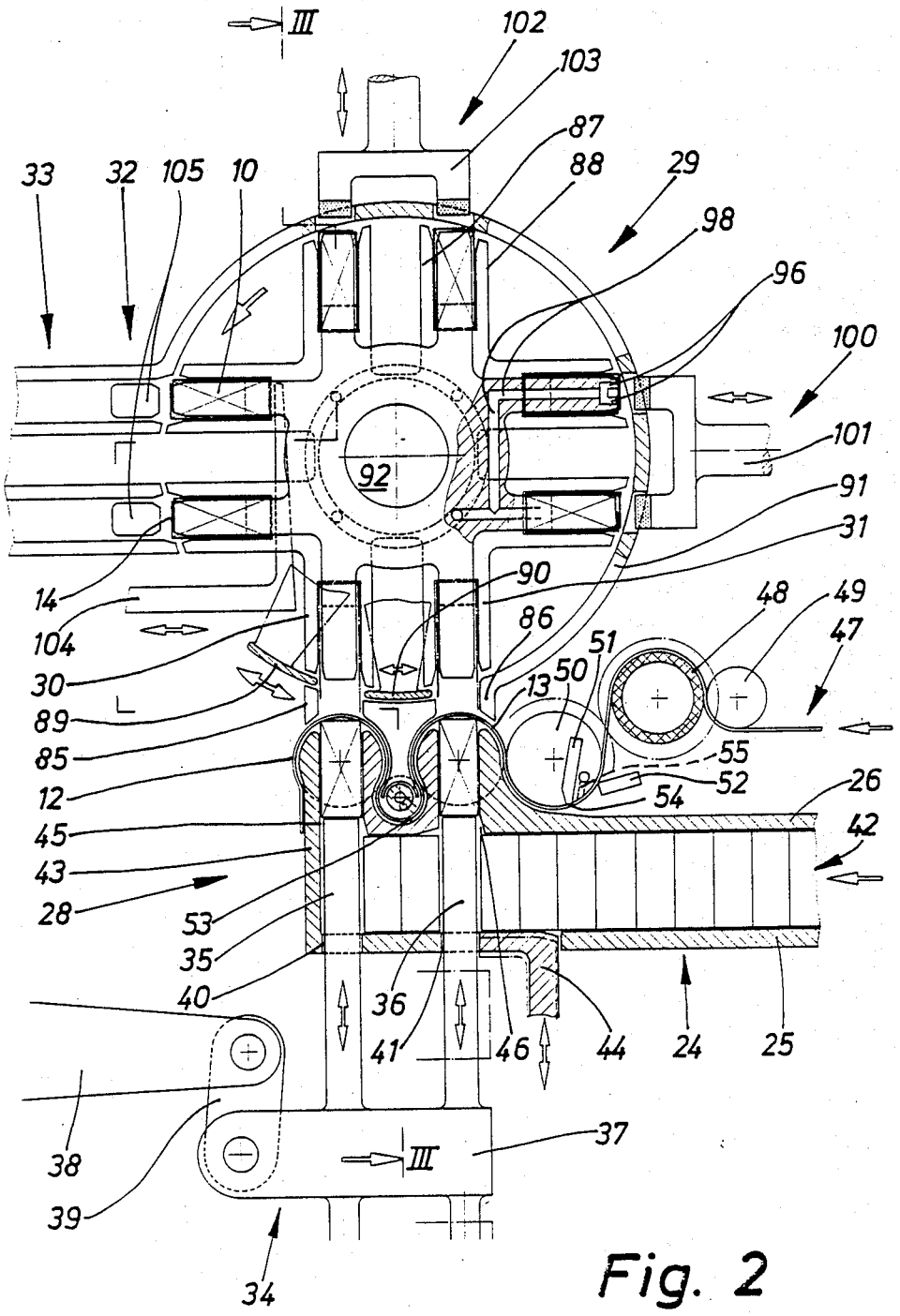
FIG. 2 shows a side view of the apparatus, partially in vertical section.
Figure 3:
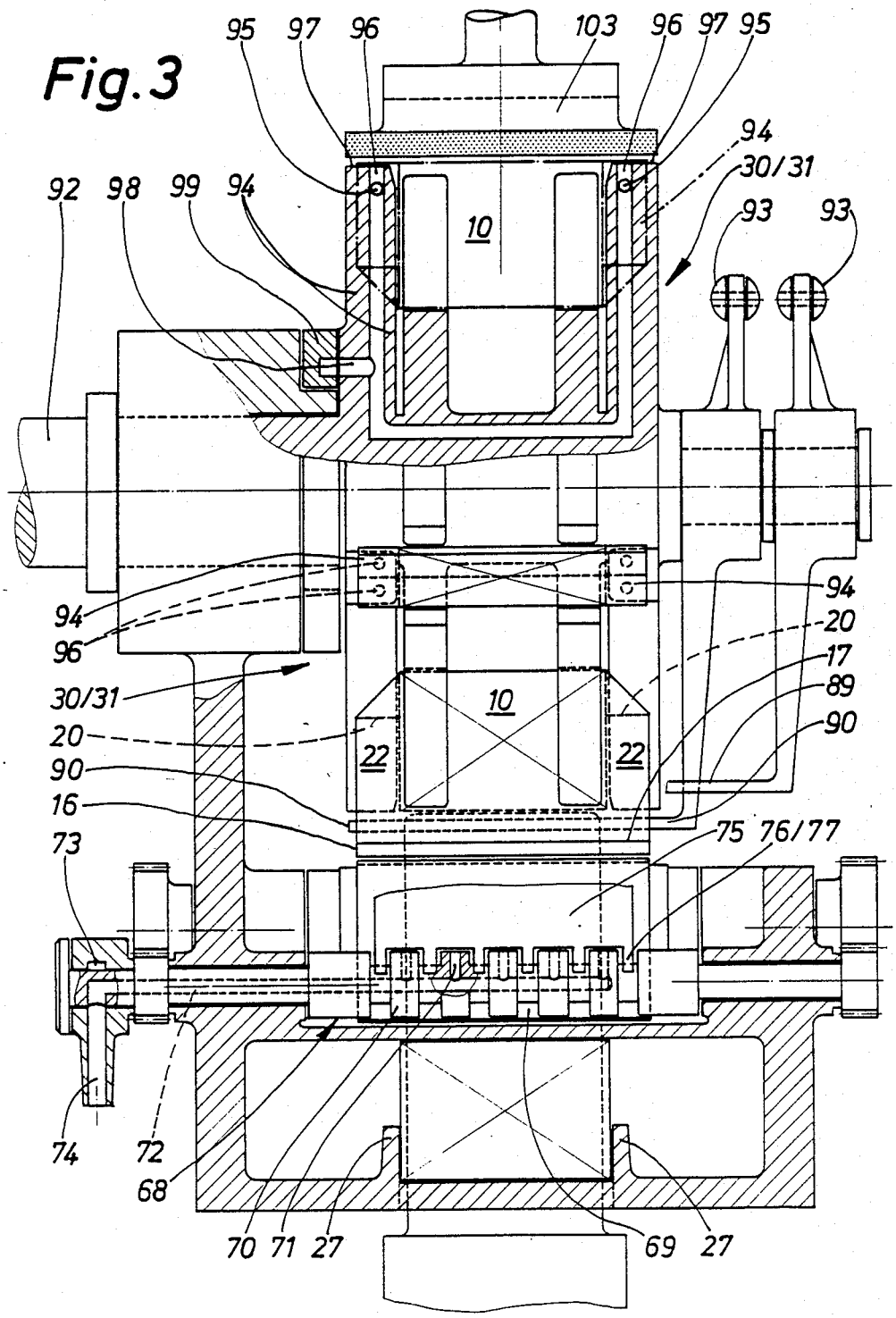
FIG. 3 shows an apparatus offset 90% relative to the representation according to FIG. 2, partially in vertical section in the plane III—III of FIG. 2 and on an enlarged scale.
Figure 8:
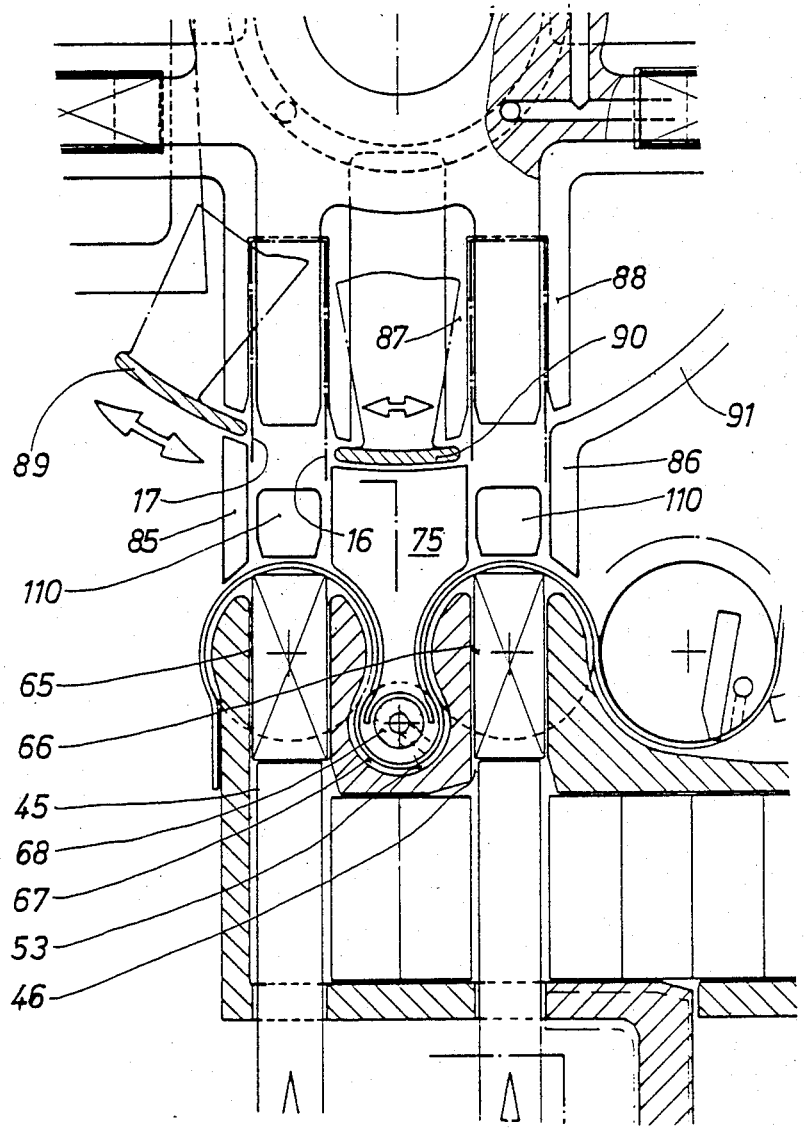
FIG. 8 shows a cutout of the apparatus in a representation corresponding to that of FIG. 1, with a modified detail.

The solution illustrated in FIG. 8 largely corresponds to that described. In contrast to the details according to FIGS. 2 and 4, in FIG. 8 stationary folding thumbs 110 are arranged in the path of movement of the cigarette packs 10 to the pockets 30, 31 of the folding turret 29 on both sides of the path of movement, in such a way that, during the movement of the cigarette packs 10 past them, the lateral end tabs 20 located at the front in the direction of movement are prefolded. The counterbody 75 and the laterally arranged outer walls 85 and 86 are made correspondingly longer.

The conveying members, in particular the drawing rollers 48, 49, the knife roller 50, the roller conveyors 56, 57 and the guide rollers 68 are mounted laterally in supporting sheets 106, 107. The drive is obtained by means of a drive shaft 108 via a plurality of gear wheels 109 intermeshing in an appropriate way.

What is claimed is:

1. In a process for wrapping packs (10) in blanks (12, 13) which are first laid around the packs in a U-shaped manner and whose projecting tabs (16, 17, 20–23) are then folded, in which process two packs (10) are simultaneously pushed into pockets (30, 31) of a folding turret (29) by a pusher, a blank (12, 13) at the same time being taken up in a U-shaped manner, the blanks (12, 13) being separated from a common web of material (47) and being conveyed in the correct position into the path of movement of the packs (10) in front of the pusher, the improvement comprising the steps of:

deforming the blanks (12, 13), or the web portion for forming the blanks, in front of the pusher in the region of said path of movement of the packs (10), in a wave-shaped manner, to reduce the necessary distance between the packs (10) to be wrapped simultaneously;

conveying the blanks into the path of movement of the packs (10);

pushing out the packs (10), to be pushed simultaneously into pockets (30, 31) of the folding turret (29), from a close-packed row (42) of packs (10) in a transverse direction relative to the packs and pushing the packs into the pockets (30, 31).

2. Process, according to claim 1, further comprising the step of conveying a web portion, corresponding to the dimension of two blanks (12, 13) and belonging to the web of material (47), in the correct position, said web portion having been separated from the web of material (47) and severed to form the two blanks (12, 13).

3. Process, according to claim 1 or 2, further comprising the step of, during the conveyance of the web of material (47), separating and severing the blanks (12, 13) from said web of material.

4. Process, according to claim 1, further comprising the step of pushing out the packs (10) from said close-packed row (42) in the transverse direction from the bottom upwardly.

5. Process, according to claim 1, further comprising the step of choosing the width of two packs as said distance between the the packs (10) to be wrapped simultaneously.

6. In an apparatus for wrapping packs (10) into blanks (12, 13) and which comprises: a pusher for the pushing of packs (10) into pockets (30, 31) of a folding turret and during which pushing the blanks are folded around the packs (10) in a U-shaped manner and are ready-folded in the region of the folding turret; conveying members, in the form of rotatable conveying rollers (48–50), for conveying a region of web of material (47), corresponding to a corresponding number of blanks (12, 13), to the packs (10) for simultaneous wrapping of two packs (10); and a separating member for severing the blanks from the web of material (47), the improvement comprising guiding means for guiding the web (47) or blanks (12, 13) in a conveying path which runs around several conveying rollers in a wave-shaped manner in front of the pusher and the path of movement of the packs (10) to be wrapped.

7. Apparatus, according to claim 6, wherein at least one conveying member comprises a knife roller (50) with a rotating severing knife (51) and a stationary counter-knife (52) to form a severing member for separating the web portion of the web of material (47), during the conveyance thereof by the conveying members, into individual blanks (12, 13) and from the web of material (47).

8. Apparatus, according to claim 6 or 7, further comprising roller conveyor means (56, 57), disposed in the region of the path of movement of the packs (10), for fixing a blank (12, 13) in the correct position.

9. Apparatus, according to claim 8, wherein said roller conveyor means comprises roller conveyors (56, 57) having laterally arranged, rotatably driven suction discs (58, 59) on whose periphery the blanks (12, 13) are held by suction air, with an edge region extending outside the cigarette packs (10) to be wrapped.

10. Apparatus according to claim 9, wherein the suction discs (58, 59) are arranged at the ends of shaft journals (60), and wherein between the suction discs (58, 59) belonging to the same roller conveyor (56, 57) are arranged, stationary non-rotatable supporting walls (61, 62 and 63, 64) for supporting the blanks (12, 13) in the region between the suction discs (58, 59).

11. Apparatus according to claim 10, wherein the supporting walls (61 to 64) respectively delimit a slot-shaped passage orifice (65, 66) for the cigarette packs (10), above the supporting walls (61 to 64) the blanks (12, 13) extending transversely relative to the direction of movement of the cigarette packs (10).

12. Apparatus according to claim 10, wherein the supporting walls (61 to 64) are equipped with curved or arcuate outerfaces which serve for the resting and guidance of the web of material (47) or of the blanks (12, 13), the supporting walls (61 to 64) being connected to an upper wall (26) of a pack track (24), and the outer faces of the supporting walls (61 to 64) forming with the top side of the upper wall (26) continuous, mutually coordinated guide faces for the web of material (47) or for the blanks (12, 13)

13. Apparatus according to claim 8, wherein said roller conveyor means comprises roller conveyors (56, 57), and wherein arranged centrally between the respective roller conveyors (56, 57) assigned to a cigarette pack (10) to be wrapped is a rotary-driven guide roller (68) for transferring the web of material (47) from one roller conveyor (56) to the next roller conveyor (57) during the advance.

14. Apparatus according to claim 13, wherein assigned to the guide roller (68) is a stationary guide member, in the form of a counterbody (75), which is arranged between the roller conveyors (56, 57) and which, as a result of an appropriate design, assists the guidance of the web of material (47) in the region of the roller conveyors (56, 57) and of the guide roller (68).

15. Apparatus according to claim 14, wherein the counterbody (57) is equipped in the lower region with fender members, in the form of fingers (76, 77) which are directed on two sides and which project into recesses (69) of the guide roller (68).

16. Apparatus according to claim 6, comprising tappets (35, 36) for pushing the two packs (10) to be wrapped simultaneously from a horizontal pack track (24) out of a close-packed row (42) in the upward direction into two parallel-directed pockets (30, 31) of the folding turret (39).

17. Apparatus according to claim 16, comprising means for positioning the cigarette packs (10), to be wrapped simultaneously, within the close-packed row (42), at a distance from one another which corresponds to the width of two cigarette packs (10).

18. Apparatus according to claim 6, wherein the folding turret (29) has four pairs of pockets (30, 31) arranged parallel to and at a distance from one another and is movable intermittently respectively over a quarter circle.

19. Apparatus according to claim 6, wherein, after the packs (10) together with blank (12, 13) have entered a pocket (30, 31) of the folding turret (29), side folders (89, 90), pivotable concentrically relative to the folding turret, are movable relative to the folding turret (29) in such a way that inner side-wall tabs (17) projecting beyond the cigarette pack (10) in the radial direction are folded.

20. Apparatus according to claim 19, characterized in that, during the further movement of the folding turret, one of the side folders (90) causes an outer side-wall tab (16) of the cigarette pack (10), located at the rear in the conveying direction, to be folded around.

* * * * *